US008396234B2

(12) United States Patent
Derleth et al.

(10) Patent No.: US 8,396,234 B2
(45) Date of Patent: Mar. 12, 2013

(54) METHOD FOR REDUCING NOISE IN AN INPUT SIGNAL OF A HEARING DEVICE AS WELL AS A HEARING DEVICE

(75) Inventors: Ralph Peter Derleth, Hinwil (CH); Guido Schuster, Staefa (CH); Reto Ansorge, Evanston, IL (US); Res Gerber, Kuesnacht (CH); Sascha Korl, Schoenenberg (CH)

(73) Assignee: Phonak AG, Stafa (CH)

( * ) Notice: Subject to any disclaimer, the term of this patent is extended or adjusted under 35 U.S.C. 154(b) by 343 days.

(21) Appl. No.: 12/866,104

(22) PCT Filed: Feb. 5, 2008

(86) PCT No.: PCT/EP2008/051417

§ 371 (c)(1),
(2), (4) Date: Aug. 4, 2010

(87) PCT Pub. No.: WO2008/104446

PCT Pub. Date: Sep. 4, 2008

(65) Prior Publication Data

US 2010/0329492 A1 Dec. 30, 2010

(51) Int. Cl.
*H04R 25/00* (2006.01)

(52) U.S. Cl. ..... 381/312; 381/313; 381/92

(58) Field of Classification Search ..... 381/312, 381/313, 317, 318, 320, 321, 71.1, 71.2, 381/71.8, 71.12, 71.13, 71.14, 91, 92, 94.1, 381/122; 379/406.01, 406.08; 704/226, 704/233

See application file for complete search history.

(56) References Cited

U.S. PATENT DOCUMENTS 6,888,949 B1 5/2005 Berghe et al.

(Continued)

FOREIGN PATENT DOCUMENTS

CH 693 759 A5 1/2004
DE 197 47 885 A1 5/1999

(Continued)

OTHER PUBLICATIONS

McCowan, et al., "Robust Speech Recognition Using Near-field Superdirective Beamforming with Post-filtering," Acoustics, Speech, and Signal Processing, 2000. ICASSP '00. Proceeding S. 2000 IEEE International Conference on Jun. 5-9, 2000, Piscataway, NJ, USA, IEEE, vol. 3, Jun. 5, 2000, pp. 1723-1726.

(Continued)

*Primary Examiner* — Huyen D Le
(74) *Attorney, Agent, or Firm* — Pearne & Gordon LLP

(57) ABSTRACT

A method for reducing noise in an input signal (110) of a hearing device comprising a transfer function (H) as well as a hearing device is disclosed. The method comprises the steps of:

capturing first and second acoustic signals by first and second acoustic-electric converters (1, 2), providing first and second input signals (110, 311) by the first and the second acoustic-electric converters (1, 2), deriving an information signal (410) by using the first and the second input signals (110, 311), deriving an information signal estimate (S) from the information signal (410), deriving a noise signal (411) by using the first and the second input signals (110, 311), deriving a noise signal estimate (N) from the noise signal (411), generating instantaneous coefficients (412, 312) for the transfer function (H) by using the information signal estimate (S) and the noise signal estimate (N), applying the transfer function (H) to the first input signal (110) or to a processed first input signal (410) generating an output signal (111), and feeding the output signal (111) to an electro-acoustic converter (5) of the hearing device.

18 Claims, 4 Drawing Sheets

U.S. PATENT DOCUMENTS

| | | | | |
|---|---|---|---|---|
| 7,657,038 | B2 * | 2/2010 | Doclo et al. | 381/94.1 |
| 7,817,808 | B2 * | 10/2010 | Konchitsky et al. | 381/94.7 |
| 2006/0013412 | A1 | 1/2006 | Goldin | |
| 2011/0293108 | A1 * | 12/2011 | Mejia et al. | 381/92 |

FOREIGN PATENT DOCUMENTS

| | | | |
|---|---|---|---|
| DE | 698 03 933 | T2 | 10/2002 |
| EP | 0 820 210 | A2 | 1/1998 |
| EP | 1 465 456 | A2 | 10/2004 |
| WO | 00/41436 | A1 | 7/2000 |
| WO | 01/95666 | A2 | 12/2001 |
| WO | 2007/106399 | A2 | 9/2007 |

OTHER PUBLICATIONS

Meyer, et al, "Multi-channel Speech Enhancement in a Car Environment Using Wiener Filtering and Spectral Subtraction," Acoustics, Speech, and Signal Processing, 1997. ICASSP-97, 1997 IEEE International Conference on Munich, Germany Apr. 21-24, 1997, Los Alamitos, CA, USA, IEEE Comput. Soc, US, vol. 2, Apr. 21, 1997, pp. 1167-1170.

Leukimmiatis, et al., "An Optimum Microphone Array Post-filter for Speech Applications," Interspeech Intl. Conf. Spoken Lang. Proc., Interspeech ICSLP; Interspeech 2006 and 9th International Conference on Spoken Language Processing, Interspeech 2006-ICSLP; Interspeech 2006 and 9th International Conference on Spoken Language Processing, vol. 5, 2006, pp. 2142-2145.

International Search Report for PCT/EP2008/051417 dated Aug. 21, 2008.

Written Opinion for PCT/EP2008/051417 dated Aug. 21, 2008.

Notice of Opposition for EP 2 238 592 dated Dec. 21, 2012.

* cited by examiner

METHOD FOR REDUCING NOISE IN AN INPUT SIGNAL OF A HEARING DEVICE AS WELL AS A HEARING DEVICE

The present invention is related to a method for reducing noise in an input signal of a hearing device as well as to a hearing device.

Unwanted background noise must be suppressed in order to improve intelligibility when using a hearing device. The acceptable noise level, at which certain speech intelligibility is preserved, is much lower for a hearing impaired person than for a person with normal hearing. In order to restore speech intelligibility—or at least listening comfort—the hearing device has to reduce unwanted background noise.

Algorithms performing noise suppression or noise cancelling in hearing devices belong to two main classes. In a first class, spatial filtering techniques are used. Thereby, at least two microphones are needed in order that noise can be suppressed or cancelled by exploiting spatial cues of the signals (e.g. beamformers, such as MVDR, GSC, MWF, FMV, etc.). In a second class, single-channel noise cancelling approaches analyze the temporal characteristics of the acoustic signal and suppress frequency bands which are contaminated by noise (e.g. noise canceller, such as spectral subtraction, STSA, etc.).

The known solutions have the following disadvantages:

The first class is not successful in rooms with reverberation. In particular, the performance of the so-called beamformer drops significantly in rooms with reverberation. Already in moderate reverberant rooms, noise suppression performance may completely vanish. In addition, beamformers are sensitive to microphone mismatch, and, finally, beamformers destroy the spatial impression of the acoustic scene (e.g. perceived location or lateralization of sources changes).

The second class, in which noise cancellers fall, fails completely in situations where the background noise has a similar temporal structure as the target signal, e.g. conversations in a restaurant. In addition, speech distortion is usually rather high if strong noise suppression is sought by applying such a noise cancelling algorithm.

It is therefore one object of the present invention to provide a method that does not have the above-mentioned drawbacks.

This object is obtained by the features given in claim 1. Further embodiments of the present invention as well as a hearing device are given in further claims.

First, the present invention is directed to a method for reducing noise in an input signal of a hearing device comprising a transfer function, the method comprising the steps of:

- capturing first and second acoustic signals by first and second acoustic-electric converters,
- providing first and second input signals by the first and the second acoustic-electric converters,
- deriving an information signal by using the first and the second input signals,
- deriving an information signal estimate from the information signal,
- deriving a noise signal by using the first and the second input signals,
- deriving a noise signal estimate from the noise signal,
- generating instantaneous coefficients for the transfer function by using the information signal estimate and the noise signal estimate,
- applying the transfer function to the first input signal or to a processed first input signal generating an output signal, and
- feeding the output signal to an electro-acoustic converter of the hearing device.

In an embodiment of the method according to the present invention, the processed first input signal is the information signal.

In further embodiments of the method according to the present invention, the information signal is, in relation to a hearing device user, a front facing cardioid obtained by a beamformer algorithm.

In further embodiments of the method according to the present invention, the noise signal is, in relation to a hearing device user, a back facing cardioid obtained by a beamformer algorithm.

In further embodiments of the method according to the present invention, the steps of deriving the information signal estimate and/or the noise signal estimate are obtained by one of the following calculations applied to the information signal and/or the noise signal, respectively:

- calculation of power spectrum density;
- calculation of absolute value;
- calculation of squared absolute value;
- calculation of logarithm.

In further embodiments of the method according to the present invention, the step of generating instantaneous coefficients for the transfer function is performed by using a Wiener filter using the information signal estimate and the noise signal estimate in particular according to the following formula:

$$W_f[k] = \frac{|S_f[k]|^2}{|S_f[k]|^2 + |N_f[k]|^2}$$

wherein f denotes a frame instance, k denotes a frequency band, S[k] corresponds to the information signal and N[k] corresponds to the noise signal.

In further embodiments of the method according to the present invention, the step is comprised of averaging of generated instantaneous coefficients.

Second, the present invention is directed to a hearing device comprising:

- at least two acoustic-electric converters providing at least first and second input signals,
- a receiver;
- a filter unit having a transfer function, the filter unit (101 being operatively connected in-between the at least two acoustic-electric converters and the receiver,
- a computing unit which is, on its input side, operatively connected to the at least two acoustic-electric converters, and, on its output side, operatively connected to the filter unit, the computing unit comprising

- means for deriving an information signal by using at least the first and the second input signals,
- means for deriving an information signal estimate from the information signal,
- means for deriving a noise signal by using the first and the second input signals,
- means for deriving a noise signal estimate from the noise signal, and
- means for generating instantaneous coefficients for the transfer function by using the information signal estimate and the noise signal estimate.

In an embodiment of the hearing device according to the present invention, the means for deriving the information signal by using at least the first and the second input signals is operatively connected in-between one of the at least two acoustic-electric converters and the filter unit.

In further embodiments of the hearing device according to the present invention, the information signal is, in relation to a hearing device user, a front facing cardioid obtained by a beamformer algorithm.

In further embodiments of the hearing device according to the present invention, the noise signal is, in relation to a hearing device user, a back facing cardioid obtained by a beamformer algorithm.

In further embodiments of the hearing device according to the present invention, the information signal estimate and/or the noise signal estimate are obtained by one of the following calculations applied to the information signal and/or the noise signal, respectively:

calculation of power spectrum density;

calculation of absolute value;

calculation of squared absolute value;

calculation of logarithm.

In further embodiments of the hearing device according to the present invention, the means for generating instantaneous coefficients for the transfer function in the filter unit comprises an implementation of a Wiener filter using the information signal estimate and the noise signal estimate in particular according to the following formula:

$$W_f[k] = \frac{|S_f[k]|^2}{|S_f[k]|^2 + |N_f[k]|^2}$$

wherein f denotes a frame instance, k denotes a frequency band, S[k] corresponds to the information signal and N[k] corresponds to the noise signal.

In further embodiments of the hearing device according to the present invention, an averaging unit (406) is operatively connected in-between the means for generating instantaneous coefficients for the transfer function and the filter unit.

The present invention is further described by referring to drawings showing several exemplified embodiments of the present invention.

Figure 1:
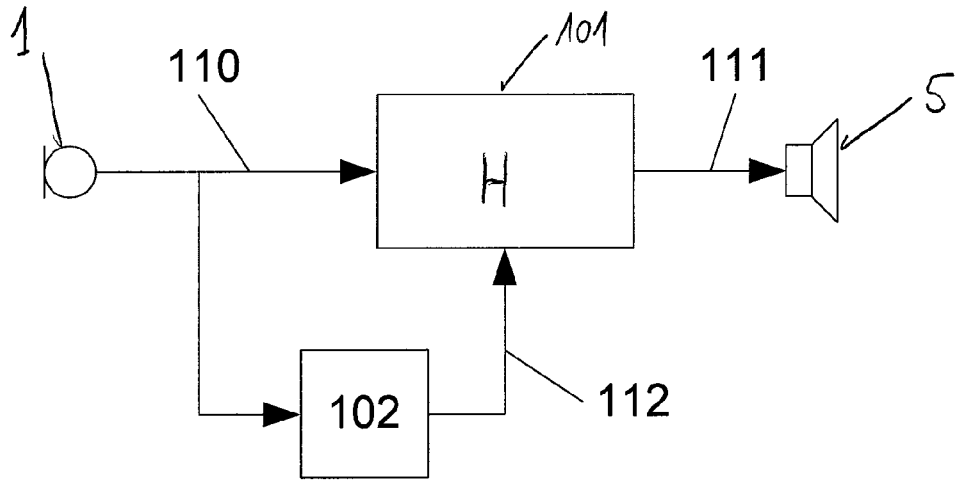
FIG. 1 shows a block diagram of a known hearing device with a noise reduction scheme.

FIG. 1 shows a block diagram of a known noise canceller, i.e. belonging to the above-mentioned first class of noise reduction schemes. An acoustic signal is picked up by a microphone 1 that is connected to a filter unit 101 as well as to an analyzing unit 102. The analyzing unit 102 is, on its output side, also connected to the filter unit 101, which in turn generates an output signal 111 that is fed to a loudspeaker 5—often called receiver in the technical field of hearing devices. In the analyzing unit 102, an SNR-(Signal-to-Noise-Ratio) is estimated (or, equivalently, speech and noise level are estimated) that is used in the filter unit 101 to adjust its transfer function—or its coefficients, respectively—in such a manner that noise in the picked-up acoustic signal 110 is suppressed or at least reduced in relation to the output signal 111 that is fed to the receiver 5. Therefore, the filter unit 101 produces the output signal 111 based on said SNR estimate such that unwanted noise components in the picked-up acoustic signal 110 are suppressed or at least reduced.

It is pointed out that the analyzing unit 102 has only access to one microphone signal. In order to estimate speech and noise levels, temporal cues—such as fluctuations of the signal amplitude—are analyzed. Fluctuations in the picked-up acoustic signal 110 with a certain modulation frequency are assumed to be speech (rhythms of syllables and words), while slower fluctuations are assumed to belong to noise. This assumption is close to reality under the condition that the noise is stationary.

Different approaches regarding the estimation of Signal-to-Noise-Ratios in a noise cancelling scheme are disclosed that can readily applied in the analyzing unit 102. Reference is made to the publication entitled "Adaptive Signal Processing" by Bernard Widrow and Samuel D. Stearns (Prentice-Hall, Inc., Englewood Cliffs, N.J., 1985), in which the SNR estimation performed in the analyzing unit 102 as well as the transfer functions applied in the filter unit 101 are extensively described.

The main problem with these first class approaches is that most of the noise signals are not stationary, which renders the assumption faulty. In particular and most importantly, these first class approaches fail completely in so-called cocktail-party situations, for instance, where the background noise (i.e. multiple speech sources) has the same fluctuations as the target signal.

Beamformers, pertaining to the second class, exploit spatial information only, on the other hand. The principle of beamforming is shown in the block diagram of FIG. 2.

Two microphones 1 and 2 are used to pick-up acoustic information. The signals picked-up by the microphones 1 and 2 are delayed in delay units 201 and 202 and subsequently subtracted from each other in the subtraction units 203 and 204 in order to form a resulting front signal 210, which has a cardioidic spatial pattern facing to the front of a hearing device user, and a similar resulting back signal 211, which possesses a cardioidic pattern facing to the back of the hearing device user. The resulting back signal 211 is weighted by an adaptive weight β in a weight unit 205, and subtracted from resulting front signal 210 in a further subtracting unit 206. The weight β is adjusted such that the energy in the output signal 212 of the further subtraction unit 206 is minimized. The output signal 212 is then fed to the receiver 5.

Figure 2:
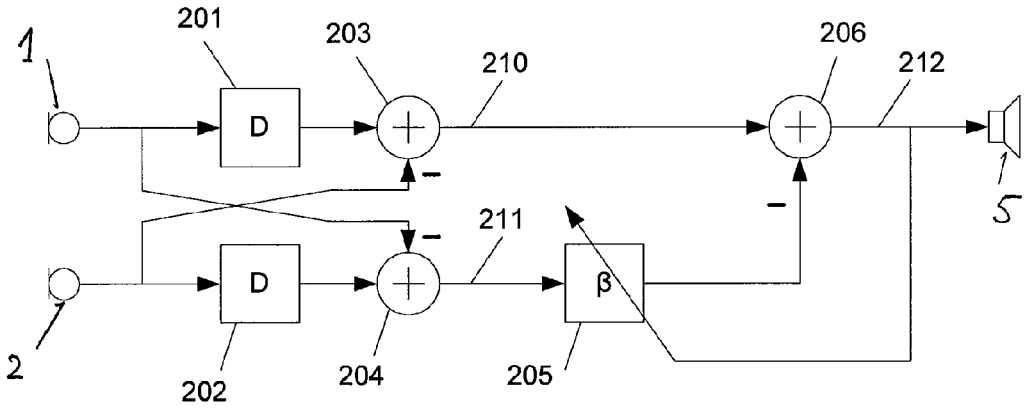
FIG. 2 shows a block diagram of a known hearing device employing a beamformer scheme.

In a beamformer, as it is depicted in FIG. 2, the subtraction of the resulting signals 210 and 211 is instantaneous and the weight β is adjusted such that the output energy is minimized. These approaches, in the first place, do not make use of spectro(-temporal) properties of the acoustic signals; noise suppression is solely achieved through the spatial separation of the sound sources. When sound sources are not spatially separated or the room is reverberant (which leads to a diffuse sound field at the microphones), noise suppression may not be achievable.

Figure 3:
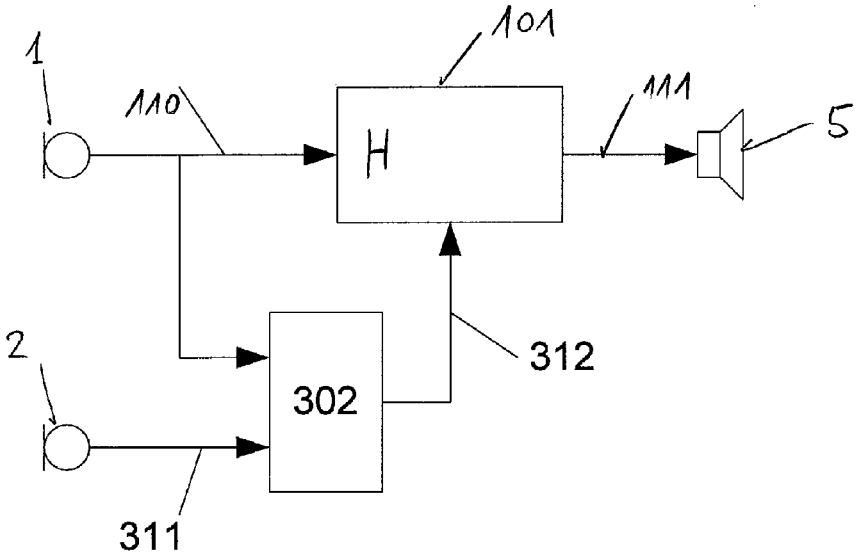
FIG. 3 shows a general concept of a hearing device according to the present invention in a simplified block diagram.

FIG. 3 shows the basic principle of the present invention again in a schematic block diagram comprising a first acoustic-electro converter 1, e.g. a microphone, a filter unit 101, a receiver 5, a computing unit 302 and a second acoustic-electro converter 2, e.g. a microphone. The first microphone 1 is connected to the filter unit 101 as well as to the computing unit 302, to which also the second microphone 2 is connected. In the computing unit 302, a transfer function H—or at least its coefficients—is computed in a manner yet to be described, and then transferred to the filter unit 101, in which the picked-up signal 110 is processed to obtain the output signal 111 being fed to the receiver 5. It is pointed out that the computing unit 302 analyzes at least two microphone signals. In fact, more than two microphone signals can be used in order to effectively compute the coefficients of the transfer function H applied in the filter unit 101.

Figure 4:
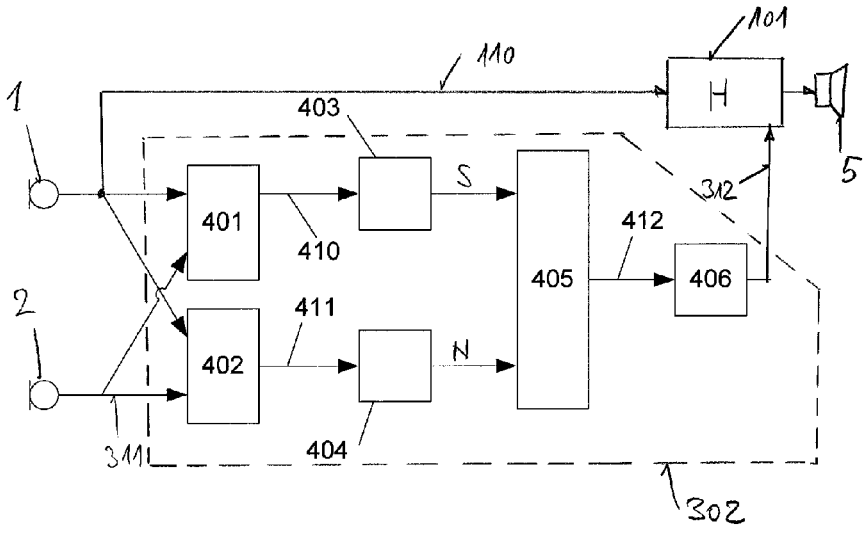
FIG. 4 shows a block diagram of a first embodiment of the present invention.

In FIG. 4, a first more specific embodiment is depicted having the same basic structure as has been shown in FIG. 3. All of the components shown in FIG. 3 can also be identified in FIG. 4, wherein the same reference signs have been used for identical components. The computing unit 302 is indicated by a dashed line comprising first and second spatial filter units 401 and 402, wherein the first spatial filter unit 401 is, for example, a fixed beamformer with a front facing cardioid, and wherein the second spatial filter unit 402 is, for example, also a fixed beamformer with a back facing cardioid. As a result of the spatial filter unit 401 a front signal 410—also called information signal hereinafter—is generated representing sounds located in the front hemisphere (or where the target signal is most likely located) relative to the hearing device user, and as a result of the spatial filter unit 402 a back signal 411—also called noise signal hereinafter—is generated representing sounds located in the back hemisphere (or where a noise signal is most likely located) relative to the hearing device user.

The computing unit 302 further comprises two estimation units 403 and 404, to one of which the information signal 410, to the other of which the noise signal 411 is fed. In the estimation units 403 and 404, the power of the front signals 410 and the power of the back signal 411 are computed resulting in a information signal estimate S and in a noise signal estimate N.

In further embodiments of the present invention, the information signal estimate S and the noise signal estimate N are determined by calculating the absolute value, the squared absolute value or the logarithm of the information signal 410 and noise signal 411, respectively, in the estimation units 403 and 404, respectively.

Each of the estimation units 403 and 404 are connected to a coefficient calculation unit 405, in which instantaneous filter coefficients are computed according to the following formula, for example:

$$W_f[k] = \frac{|S_f[k]|^2}{|S_f[k]|^2 + |N_f[k]|^2}$$

wherein f denotes the frame instance, k denotes the frequency band (i.e. FFT bin), S[k] corresponds to the information signal 410 and N[k] corresponds to the noise signal 411.

The instantaneous filter coefficients 412 are smoothed in an averaging unit 406 to produce smoothed filter coefficients 312, which are used in the filtering unit 101. Therefore, the averaging unit 406 is connected in-between the coefficient calculation unit 405 and the filter unit 101.

The instantaneous filter coefficients 412 are fed to the averaging unit 406 to prevent a fast changing transfer function H of the filter unit 101 due to fast changing filter coefficients. The transfer function H with the smoothed filter coefficients are applied to the input signal 110 picked-up by the first microphone 1.

Figure 5:
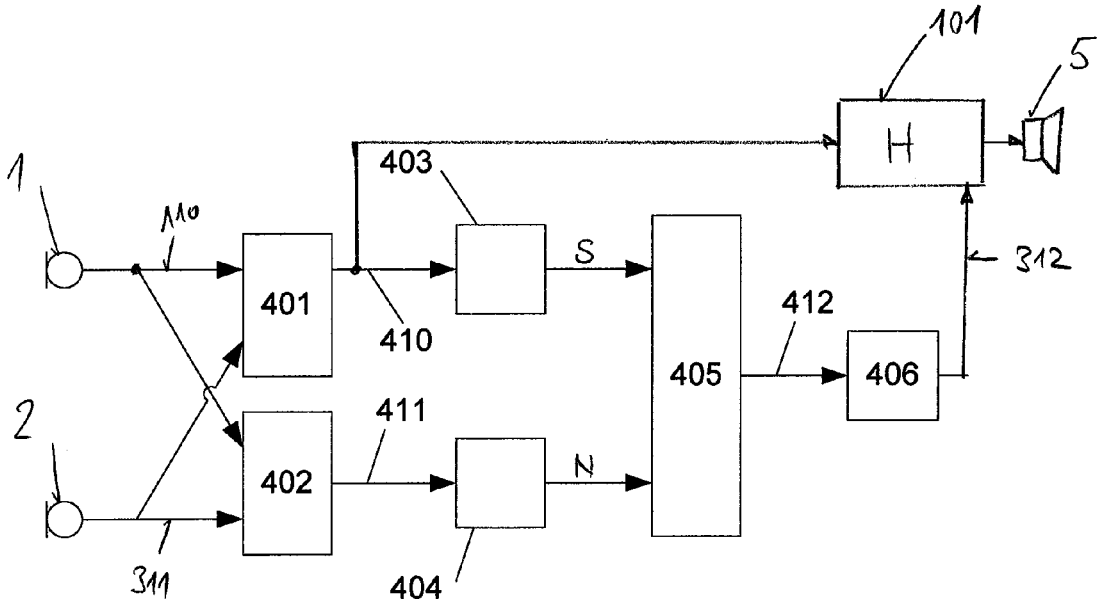
FIG. 5 shows a block diagram of a second embodiment of the present invention.

In FIG. 5, a further embodiment of the present invention is depicted. In contrast to the embodiment according to FIG. 4, the embodiment of FIG. 5 differs in that the input signal to the filter unit 101 is not the unprocessed signal 110 picked-up by the microphone 1, but it is the information signal 410 that is the output signal of the spatial filter unit 401 having a cardioidic spatial pattern facing to the front of a hearing device user. In fact, the input signal to the filter unit 101 is now a processed signal of the signal picked-up by the microphone 1.

Figure 6:
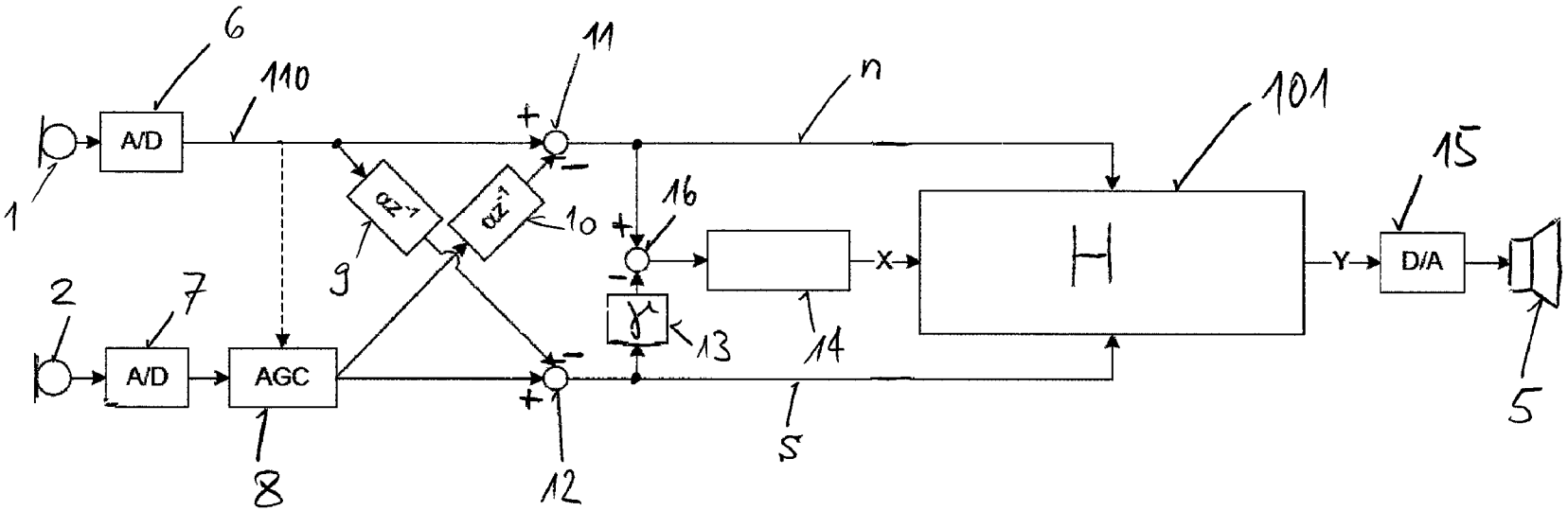
FIG. 6 shows a more specific block diagram of the second embodiment of the present invention.

In FIG. 6, a block diagram of a further embodiment of the present invention is depicted. The block diagram represents one channel, i.e. each ear gets its own independent channel having an identical structure but do not necessarily share information. In behind-the-ear hearing devices, two omni-directional microphones 1 and 2 are usually provided. The one closer to the front of a hearing device user is a front microphone 1, the other one being a back microphone 2. The signals picked-up by the microphones 1 and 2 are then digitized in respective analog-to-digital converters 6 and 7 at a sample rate that is selected such that between two samples, the sound can travel from the front to the back microphone 1, 2. With this sample rate, it becomes easy to build forward and backward facing cardioidic signals using the signals picked-up by the omni-directional microphones 1 and 2.

Since the microphones 1 and 2 are not perfectly matched, an AGC-(Automatic Gain Control) unit 8 controls the average level of the signal picked-up by the back microphone 2 so that it has the same average level as the front microphone 1. This is achieved, for example, by using a first order IIR-(Infinite Impulse Response) lowpass filter (incorporated into the AGC unit 8), which smoothes out the absolute value of the front microphone 1 and one IIR lowpass filter that smoothes out the signal picked-up by the back microphone 2. The ratio between these two smoothed absolute levels is then used as the gain for the back microphone 2. Usually one would use the squared value of the signal to drive the lowpass filters and then take the square root of the smoothed output to get a measure of the standard deviation of the signals. Since the square and especially the square root operations are computationally expensive, the absolute value is preferably used instead. This helps to keep the computational efforts low.

After this normalization step, the differences between the front and the back microphones 1 and 2 are computed by a first subtraction unit 11, where for the forward cardioid, the delayed back microphone signal (using a delay unit 10 having a transfer function of $\alpha \cdot z^{-1}$) is subtracted and for the backward cardioid, the delayed forward microphone signal (using a delay unit 9 having a transfer function of $\alpha \cdot z^{-1}$) is subtracted. Since the sampling rate has been selected such that delaying by one sample is identical to the time the sound needs to travel between the microphones 1 and 2, this subtraction erases the contribution of a noise source located perfectly behind the hearing device user in the top signal path of FIG. 6. In the bottom signal path of FIG. 6, this subtraction erases the contribution of a speech source located perfectly in front of the hearing device user. This subtraction is performed by a corresponding subtraction unit 12.

It is noted that the signals picked-up by the microphones 1 and 2 are not only delayed, but they are also attenuated by a factor $\alpha$, which is set to 0.965, for example. Since the front cardioid and the back cardioid are the results of a difference operation, they not only show a spatial pattern, but they also result in a highpass behavior. This can be corrected using a lowpass filter, or, as it is shown in FIG. 6, with an equalizer unit 14, which has the inverse transfer function of the beamformer, i.e.

$$\frac{1}{1 - \alpha \cdot z^{-2}}$$

To make sure that the equalizer unit 14 has a stable behavior, a factor $\alpha$ smaller than one needs to be selected. Besides being an elegant solution to the highpass problem of a first order beamformer, such an equalizer unit 14 having the above-mentioned transfer function also has the advantage that it can be implemented very efficiently. This is important when implementing a low complexity algorithm as it is suggested here.

The two cardioid signals are then used for the adaptive time domain beamformer, which calculates a factor γ in a factor unit 13, in which the back cardioid signal (i.e. noise signal) is scaled by the factor γ so that it can be subtracted from the forward cardioid signal (i.e. information signal) in a further or third subtraction unit 16. The factor γ is calculated using a stochastic descent algorithm, for example, where the factor γ is constrained to stay between zero and one. This results in a spatial pattern, which can move its zero to the location in the back half plane where the noise source is located.

As mentioned above, the cardioids have a high pass characteristic, which needs to be equalized. This is done after the weighed subtraction of the back cardioid from the front cardioid in the third subtraction unit 16 and can be done using the equalizer unit 14 discussed above. The resulting beamformed noisy speech signal is then called x, since it will be the input to the filter unit 101, which is, for example, an averaged instantaneous Wiener filter. As the forward cardioid signal and the backward cardioid signal are used for estimating the power spectrum densities (PSD) of the information signal (speech) and the noise signal, one would expect that they also must be processed by an equalizer. Since the PSDs of the information signal and the noise signal are only used in the Wiener formula, where a common lowpass will be cancelled, an equalization of the information and the noise signal is not necessary. Again, computational effort can be saved. In FIG. 6, s is used for the information signal (forward cardioid), and n is used for the noise signal (backward cardioid).

The instantaneous coefficients W of the transfer function H applied to the input signal x are obtained in the following manner:

$$W = (1-\beta)\cdot W + \frac{\beta\cdot\|S\|^2}{\|S\|^2+\|N\|^2}$$

Wherein S is the power spectrum density of the information signal s, and N is the power spectrum density of the noise signal n.

Since the filtering is achieved in the frequency domain (which can be Bark or FFT) and the filtering is done using, for example, a 128-samples frame, the frequency domain frames are called X for the input signal, S for the information signal, and N for the noise signal, which are, in this example using 128-samples frame, vectors also of length 128. To keep the computational and memory burden low, a simple first order IIR filter is used to smooth the Wiener weights W. In the current implementation, the IIR filter parameter β was selected such that, under the worst condition that a large reverberating room with broadband noise is to be dealt with, no musical noise could be heard. This was the case for β=0.05, for example, which corresponds in this embodiment of the present invention to a time constant of about 30 ms. This is a relatively fast time constant, which results in a quick convergence that cannot be heard during regular operation.

Because the determination of the output signal y, which is fed to the receiver 5 via the digital-to-analog converter 15, is determined in the frequency domain, the power spectrum density of the output signal Y is obtained by a simple multiplication:

$$Y=W\cdot X.$$

What is claimed is:

1. A method for reducing noise in an input signal (110) of a hearing device comprising a transfer function (H), the method comprising the steps of:

capturing first and second acoustic signals by first and second acoustic-electric converters (1,2), providing first and second input signals (110, 311) by the first and the second acoustic-electric converters (1, 2), deriving an information signal (410) by using the first and the second input signals (110, 311), deriving an information signal estimate (S) from the information signal (410), deriving a noise signal (411) by using the first and the second input signals (110, 311), deriving a noise signal estimate (N) from the noise signal (411), generating instantaneous coefficients (412, 312) for the transfer function (H) by using the information signal estimate (S) and the noise signal estimate (N), applying the transfer function (H) to the first input signal (110) or to a processed first input signal (410) generating an output signal (111), and feeding the output signal (111) to an electro-acoustic converter (5) of the hearing device.

2. The method of claim 1, wherein the processed first input signal is the information signal (410).

3. The method of claim 1 or 2, wherein the information signal (410) is obtained by a beamformer algorithm from a front facing cardioid in relation to a hearing device user.

4. The method of claim 1, wherein the noise signal (411) is obtained by a beamformer algorithm from a back facing cardioid in relation to a hearing device user.

5. The method of claim 1, wherein the steps of deriving the information signal estimate (S) and/or the noise signal estimate (N) are obtained by one of the following calculations applied to the information signal (410) and/or the noise signal (411), respectively:

calculation of power spectrum density;

calculation of absolute value;

calculation of squared absolute value;

calculation of logarithm.

6. The method of claim 5, wherein the step of generating instantaneous coefficients (412, 312) for the transfer function (H) is performed by using a Wiener filter using the information signal estimate (S) and the noise signal estimate (N) in particular according to the following formula:

$$W_f[k] = \frac{|S_f[k]|^2}{|S_f[k]|^2+|N_f[k]|^2}$$

wherein f denotes a frame instance, k denotes a frequency band, S[k] corresponds to the information signal (410) and N[k] corresponds to the noise signal (411).

7. The method of claim 1, wherein the step of generating instantaneous coefficients (412, 312) for the transfer function (H) is performed by using a Wiener filter using the information signal estimate (S) and the noise signal estimate (N) in particular according to the following formula:

$$W_f[k] = \frac{|S_f[k]|^2}{|S_f[k]|^2 + |N_f[k]|^2}$$

wherein f denotes a frame instance, k denotes a frequency band, S[k] corresponds to the information signal (410) and N[k] corresponds to the noise signal (411).

8. The method of claim 7, further comprising the step of averaging the generated instantaneous coefficients (412).

9. The method of claim 1, further comprising the step of averaging the generated instantaneous coefficients (412).

10. A hearing device comprising:

at least two acoustic-electric converters (1, 2) providing at least first and second input signals (110, 311), a receiver (5);

a filter unit (101) having a transfer function (H), the filter unit (101) being operatively connected in-between the at least two acoustic-electric converters (1, 2) and the receiver (5), characterized by further comprising a computing unit (302) having an input side and an output side, with the input side operatively connected to the at least two acoustic-electric converters (1, 2), and with the output side operatively connected to the filter unit (101), the computing unit (302) comprising means for deriving an information signal (410) by using at least the first and the second input signals (110, 311), means for deriving an information signal estimate (S) from the information signal (410), means for deriving a noise signal (411) by using at least the first and the second input signals (110, 311), means for deriving a noise signal estimate (N) from the noise signal (411), and means for generating instantaneous coefficients (412, 312) for the transfer function (H) by using the information signal estimate (S) and the noise signal estimate (N).

11. The hearing device according to claim 10, characterized in that the means for deriving the information signal (410) by using at least the first and the second input signals (110, 311) is operatively connected in-between one of the at least two acoustic-electric converters (1, 2) and the filter unit (101).

12. The hearing device according to claim 10 or 11, characterized in that the information signal (410) is obtained by a beamformer algorithm from a front facing cardioid in relation to a hearing device user.

13. The hearing device according to claim 10, characterized in that the noise signal (411) is obtained by a beamformer algorithm from a back facing cardioid in relation to a hearing device user.

14. The hearing device according to claim 10, characterized in that the information signal estimate (S) and/or the noise signal estimate (N) are obtained by one of the following calculations applied to the information signal (410) and/or the noise signal (411), respectively:

calculation of power spectrum density;

calculation of absolute value;

calculation of squared absolute value;

calculation of logarithm.

15. The hearing device according to claim 14, characterized in that the means for generating instantaneous coefficients (412) for the transfer function (H) in the filter unit (101) comprises an implementation of a Wiener filter using the information signal estimate (S) and the noise signal estimate (N) in particular according to the following formula:

$$W_f[k] = \frac{|S_f[k]|^2}{|S_f[k]|^2 + |N_f[k]|^2}$$

wherein f denotes a frame instance, k denotes a frequency band, S[k] corresponds to the information signal (410) and N[k] corresponds to the noise signal (411).

16. The hearing device according to claim 10, characterized in that the means for generating instantaneous coefficients (412) for the transfer function (H) in the filter unit (101) comprises an implementation of a Wiener filter using the information signal estimate (S) and the noise signal estimate (N) in particular according to the following formula:

$$W_f[k] = \frac{|S_f[k]|^2}{|S_f[k]|^2 + |N_f[k]|^2}$$

wherein f denotes a frame instance, k denotes a frequency band, S[k] corresponds to the information signal (410) and N[k] corresponds to the noise signal (411).

17. The hearing device according to claim 16, characterized in that an averaging unit (406) is operatively connected in-between the means for generating instantaneous coefficients (312) for the transfer function (H) and the filter unit (101).

18. The hearing device according to claim 10, characterized in that an averaging unit (406) is operatively connected in-between the means for generating instantaneous coefficients (312) for the transfer function (H) and the filter unit (101).

* * * * *